US005564684A

United States Patent [19]

Salancy

[11] Patent Number: 5,564,684

[45] Date of Patent: Oct. 15, 1996

[54] ANTI-SHINGLING BUCKLE CHUTE FOLDER SYSTEM

[75] Inventor: William A. Salancy, Norwalk, Conn.

[73] Assignee: Pitney Bowes Inc., Stamford, Conn.

[21] Appl. No.: 395,235

[22] Filed: Feb. 27, 1995

[51] Int. Cl.[6] ..... B65H 45/14

[52] U.S. Cl. ..... 270/45; 493/420; 493/421

[58] Field of Search ..... 270/45; 493/420, 493/421

[56] References Cited

U.S. PATENT DOCUMENTS

| | | | |
|---|---|---|---|
| 3,211,448 | 10/1965 | Stoothoff | 493/421 |
| 3,510,122 | 5/1970 | Gavaghan | 493/421 |
| 3,975,009 | 8/1976 | Brown | 493/421 X |
| 4,573,672 | 3/1986 | Lehmann et al. | 270/45 |
| 4,816,108 | 3/1989 | Beck et al. | 493/421 X |
| 4,842,574 | 6/1989 | Noble et al. | 493/421 |
| 5,242,369 | 9/1993 | Eschweiler, Jr. et al. | 493/420 X |
| 5,246,415 | 9/1993 | Fuss | 493/421 X |
| 5,437,597 | 8/1995 | Boughton et al. | 493/421 X |
| 5,441,244 | 8/1995 | Bartoes et al. | 270/45 |

*Primary Examiner*—John E. Ryznic

*Attorney, Agent, or Firm*—Lawrence E. Sklar; Melvin J. Scolnick

[57] ABSTRACT

A buckle chute folding system for imparting a fold to a collation of paper sheets. The system includes: a substantially vertically oriented buckle chute; a pair of upper and lower feeding rollers defining a feed nip upstream of the buckle chute; a third feed roller associated with the lower feed roller, the third feed roller and lower feed roller defining a feed nip; and a device for positively driving the upper feeding roller, whereby the collation of sheets is fed through the nips into the buckle chute without any shingling effects.

7 Claims, 4 Drawing Sheets

ANTI-SHINGLING BUCKLE CHUTE FOLDER SYSTEM

BACKGROUND OF THE INVENTION

The instant invention relates to a buckle chute folding system for paper documents and more particularly to apparatus for eliminating the shingling effect on documents as they change from the horizontal to vertical direction of travel and enter the nip of a pair of feed rollers associated with the buckle chute folding system.

Buckle chute paper folders employing folding rollers are well known. A sheet of paper is fed by a first pair of feed rollers into a buckle chute, which stops the forward progress of the paper sheet and causes a buckle to be formed. The buckle is then forced to enter the nip of a pair of folding rollers (one of which may be one of the feed rollers) which impart a crease in the buckle. The folding rollers then continue to feed the folder sheet toward a pair of exit rollers or another buckle chute for forming a second fold or inverting the document so that the top surface becomes the bottom surface and vice versa.

There is a problem with respect to accurately folding a stack of documents at one time since the paper path of the documents to be folded is such that the documents are guided along an angular path away from the normal path of travel constituting a substantially straight path through the apparatus. When the stack of documents is guided along such a diverted angular path, the outermost document of the stack travels a shorter (or longer) distance than the inside document when the stack is positively pushed or conveyed by cooperating pairs of feeding rollers. The result is that no two of the documents in the folded stack have exactly the same fold. This lack of uniform folding causes the folded stack to be unevenly folded, and in the case of varying folded sizes of documents, may result in some of the documents exceeding the size of the opened envelope into which the folded stack is to be inserted, thereby preventing insertion.

In dealing with the aforementioned problem, which results in a shingling effect on the documents prior to their being folded, the prior art has introduced the use of a free wheeling foam roller adjacent one of the first pair of feed rollers, generally the lower of the two feed rollers. Use of the free wheeling roller adjacent one of the first pair of feed rollers did prove helpful in reducing shingling, but did not eliminate shingling in all cases. The instant invention thus provides apparatus which results in the shingling effect being virtually eliminated in all applications in which collations of paper sheets are folded by a buckle chute folder.

Accordingly, the instant invention allows a collation of paper sheets to change from a horizontal to a vertical direction of travel prior to the collation being folded and prevents the documents from becoming shingled prior to their being folded.

SUMMARY OF THE INVENTION

Thus, the instant invention provides a buckle chute folding system for imparting a fold to a collation of paper sheets. The system includes: a substantially vertically oriented buckle chute; a pair of upper and lower feeding rollers defining a feed nip upstream of the buckle chute; a third feed roller associated with the lower feed roller, the third feed roller and lower feed roller defining a feed nip; and means for positively driving the upper feeding, whereby the collation of sheets is fed through the nips into the buckle chute without any shingling effects.

DETAILED DESCRIPTION OF THE PREFERRED EMBODIMENT

Figure 1:
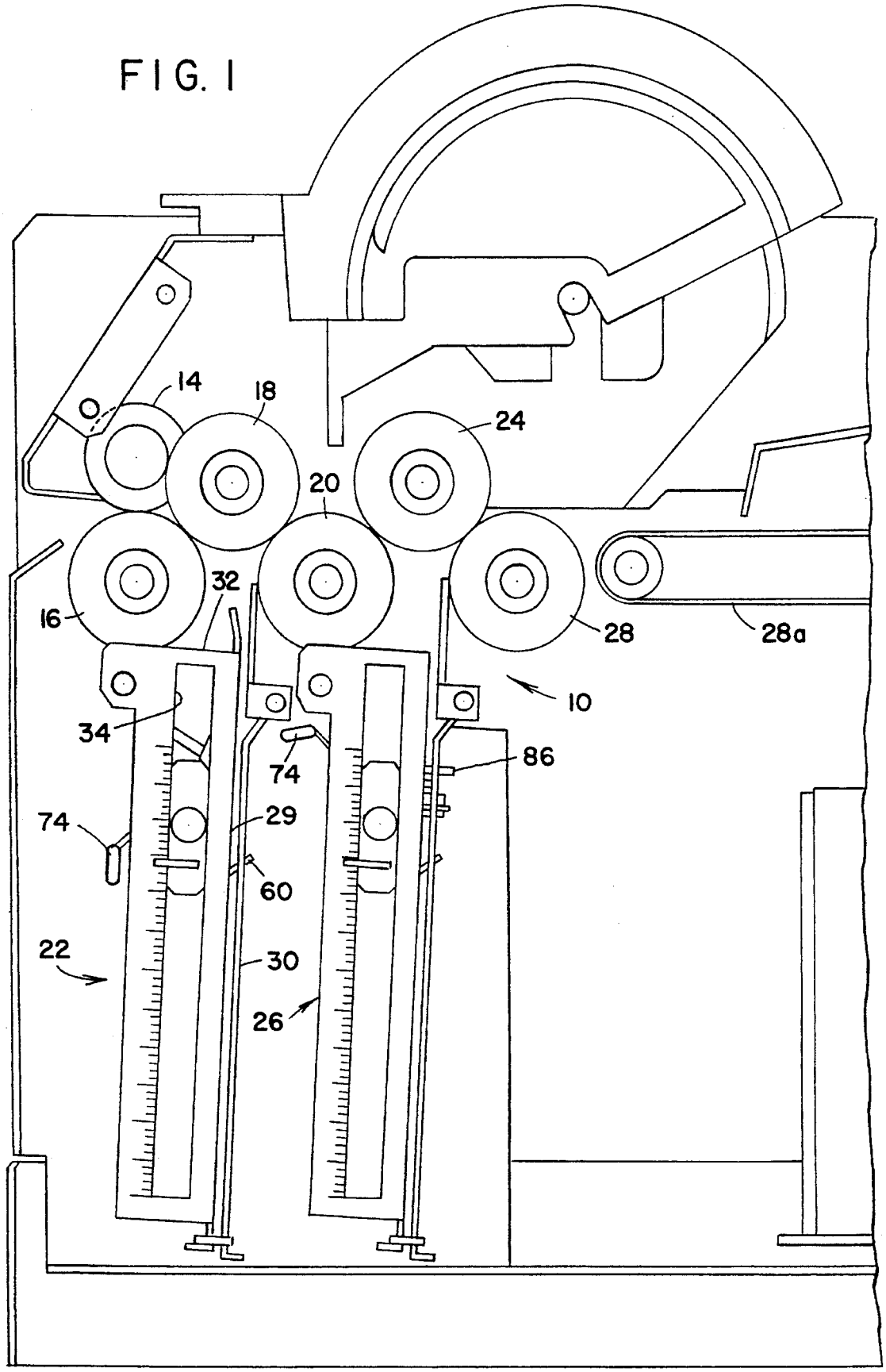
FIG. 1 is a side, elevational view of a buckle chute folding system in accordance with the instant invention.
Figure 2:
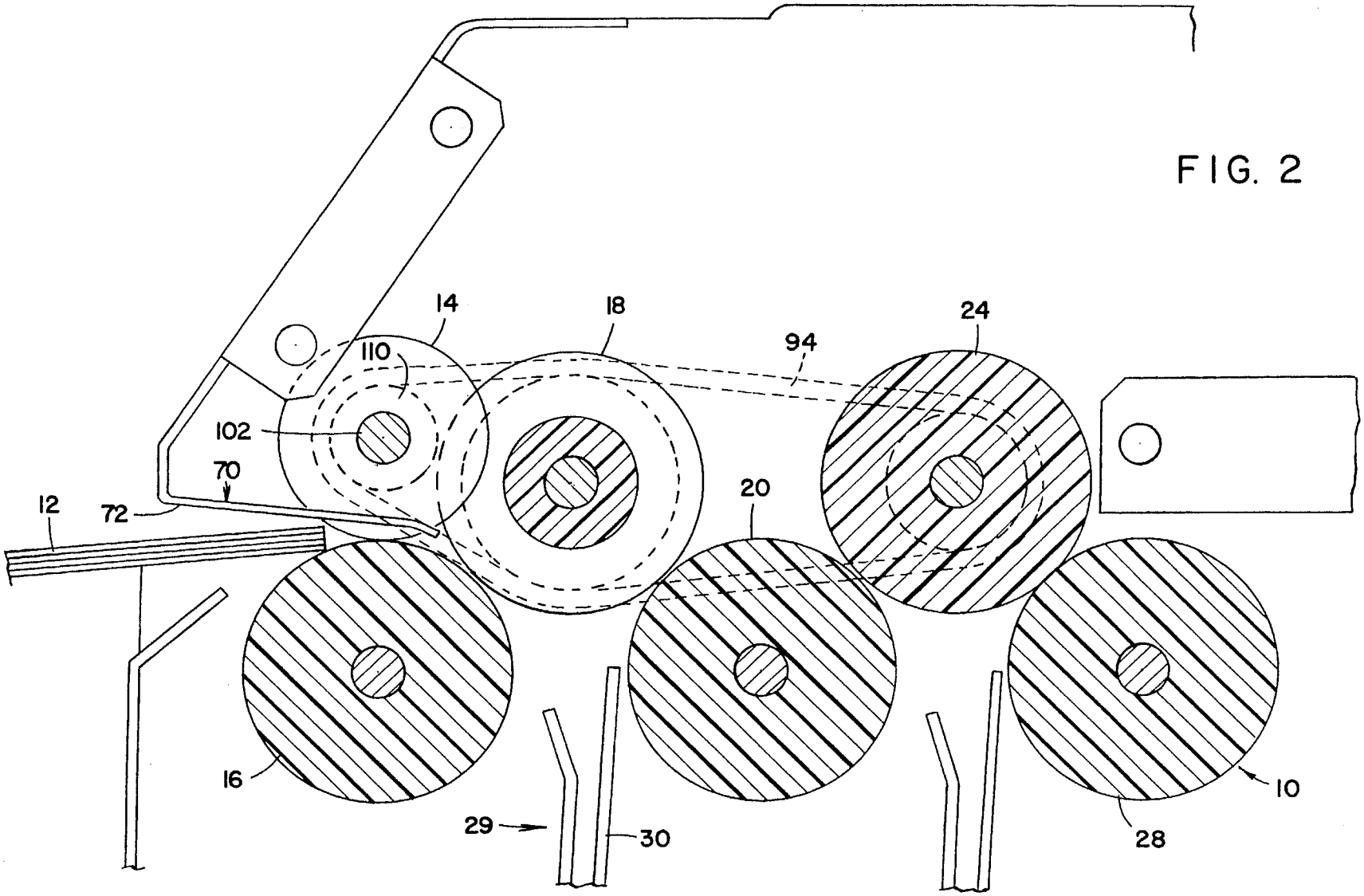
FIG. 2 is an enlarged, side elevational view showing the various rollers and guides used in the folding system, and a collation of paper entering the nip of the first pair of rollers.

In describing the preferred embodiment of the instant invention, reference is made to the drawings, wherein there is seen in FIG. 1 buckle chute folding apparatus generally designated 10 capable of imparting two successive folds to a collation of several sheets of paper 12 (see FIG. 2). Alternatively, the folding apparatus 10 can be used to invert a collation of paper and then impart a single fold, or impart a single fold and then invert the paper. The sheets of paper 12 are fed from paper handling devices (not shown) located upstream of the folding apparatus 10, such as feeders and collators, to five, segmented, first feed rollers 14, to be discussed in detail hereinbelow, and a second feed roller 16. Associated with the second feed roller 16 is a first, segmented folding roller 18 and together they function as a pair of feeding rollers. A second folding roller 20 is associated with the first folding roller 18. Downstream of the folding rollers 16 and 18 is a first buckle chute 22.

Associated with the second folding roller 20 is a third folding roller 24, downstream of which is a second buckle chute 26. Associated with the third folding roller 24 is a fourth folding roller 28. The folding rollers 20 and 24 cooperate to function as a pair of feeding rollers as will be explained further hereinbelow. Downstream of the folding rollers 24 and 28 is a conveyor belt **28*a* for further transporting the folded sheets of paper 12**.

In describing the buckle chutes 22 and 26, reference will be made to the first buckle chute 22, but since the buckle chutes 22 and 26 are identical, the description of the first buckle chute 22 will apply equally as well to the second buckle chute 26. The buckle chute 22 consists of a first plate 29 and an opposing plate 30. The first plate 29 includes a perpendicular flange 32 having a longitudinally extending channel 34. A pair of tabs 60 project through a pair of slots in the first plate 29 and function as stops for the paper sheets 12 entering the buckle chute 22. A pair of plungers 86 are pivoted by a lever 74 (see FIG. 1 ) between the position shown for the chute 22 and the chute 26. For the chute 22, the plungers 86 are behind the first plate 29 to allow the paper sheets 12 to reach the stopping tabs 60, which allows the buckle chute 22 to function in its regular, folding mode, as is well known. For the chute 26, the plungers 86 are positioned in the paper path of the buckle chute 26, which allows the buckle chute 26 to operate in an inverting mode, so that, for example, the address on a document will be in the correct location for insertion into a windowed envelope (not shown).

As seen in FIG. 2, upstream of the rollers 14 and 16 is an entrance bracket 70 for guiding the paper collations 12 into the nip of the rollers 14 and 16. The bottom side 72 of the entrance bracket 70 is Teflon coated and curved downward at its downstream end to aid in deflecting the collation 12 from a horizontal to a vertical orientation. The bottom side 72 can be coated with any material which provides a slippery surface.

Figure 4:
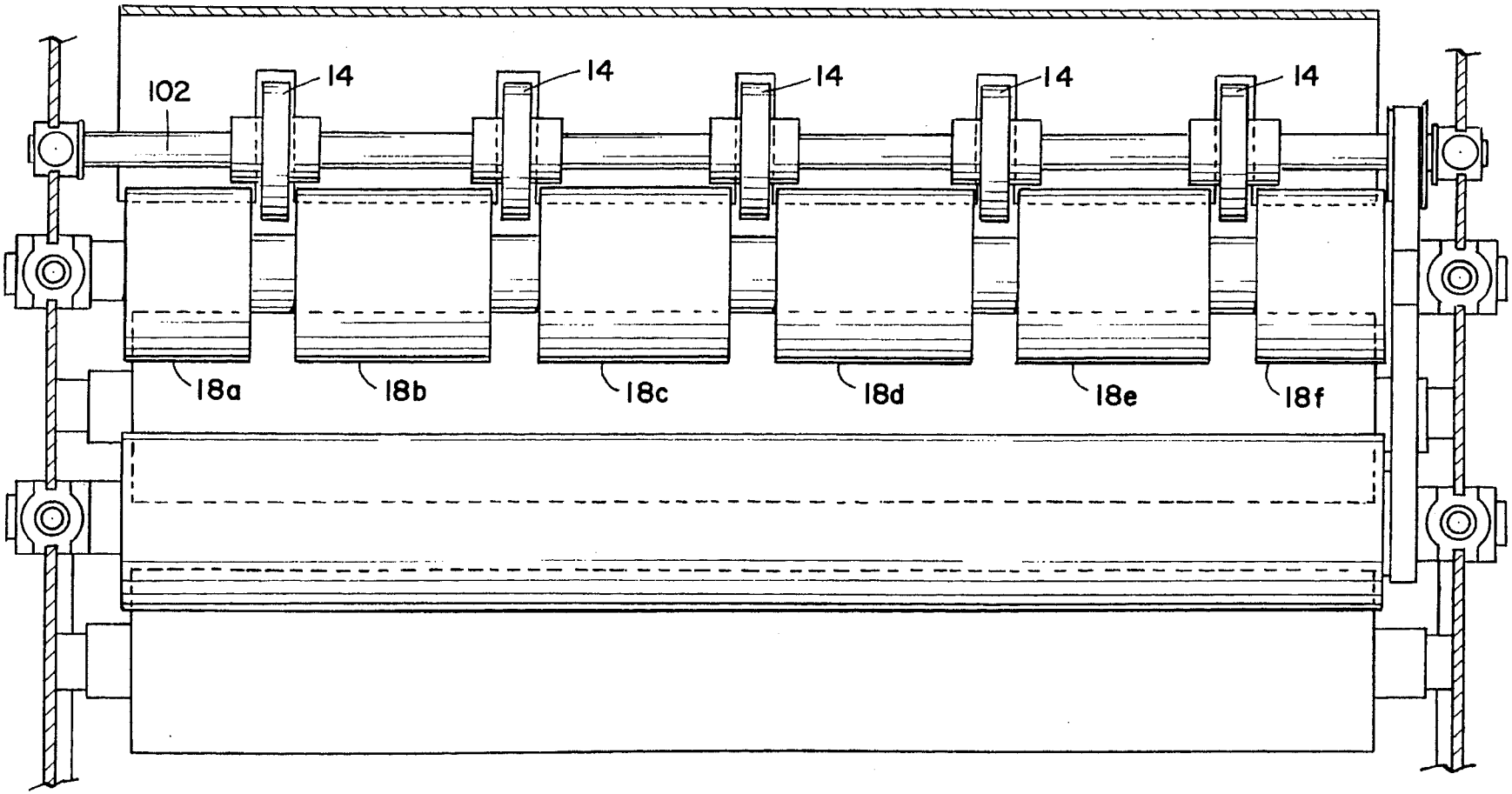
FIG. 4 is a top view of the apparatus seen in FIGS. 2 and 3.

Focusing now on the five, segmented feed rollers 14, reference is made to FIG. 4, where it can be seen that the five rollers 14 are fixedly mounted on a shaft 102. A pulley 110 (see FIG. 2) is secured to the shaft 102, and a belt 94 engages the pulley 110 and positively drives the shaft 102, which in turn causes the five feed rollers 14 to be positively driven. It is to be understood that the phrase "positively driven" means that the feed rollers 14 have a consistent, non-varying, reliable form of drive, which could include a chain drive, as opposed to being driven by another roller which can separate or be displaced by a collation and thereby vary the drive. As previously indicated, the folding roller 18 is segmented, and includes segments 18*a–f* which are uniformly spaced from each other. The five rollers 14 extend into the gaps between the roller segments 18*a–f* in order to fit the five rollers 14 at the optimum location with respect to the second feed roller 16. Each of the five rollers 14 is formed from a soft rubber, which can include a foam material. Although the feed roller 14 is shown as segmented, it can consist of a one single roller; its configuration would depend on the arrangement of the rollers 16 and 18, and the relative sizes of the rollers involved. Moreover, if the roller 14 is to be segmented, it can be segmented into whatever number is desired.

Figure 3:
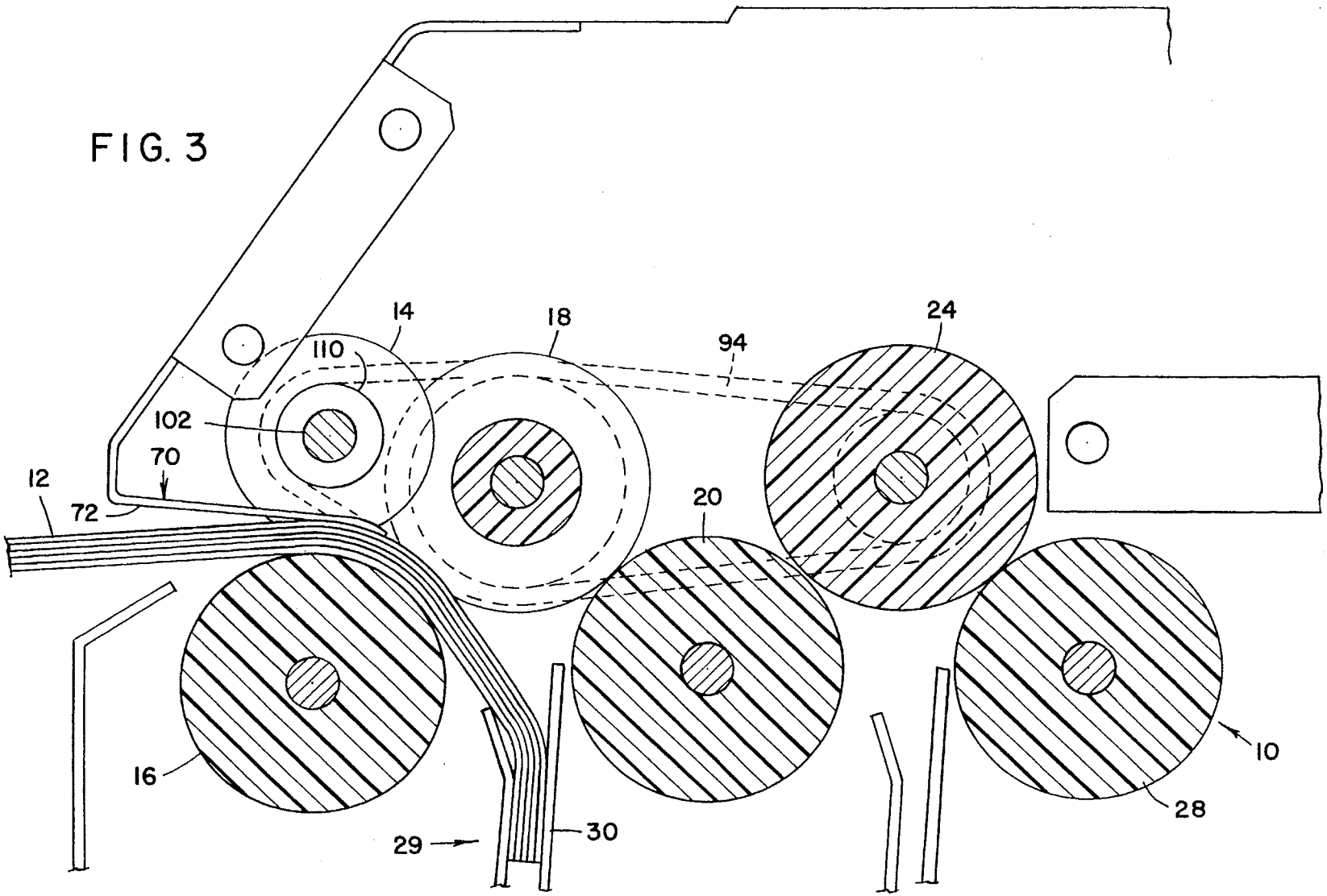
FIG. 3 is similar to FIG. 2 but shows the collation entering the first buckle chute.

The arrangement of the buckle chutes 22 and 26 seen in FIG. 1 is designed for the first buckle chute 22 to impart a single fold to a collation of sheets of paper 12 and the second buckle chute 26 to invert the once-folded paper sheets 12. The paper 12 is fed from paper handling devices (not shown) located upstream of the folding apparatus 10 and under the entrance bracket 70 to the segmented, first feed rollers 14 and the second feed roller 16 (see FIG. 2) and then to the nip of the second feed roller 16 and the first, segmented folding roller 18, after which the paper 12 enters the first buckle chute 22 (see FIG. 3). The paper then is stopped in the buckle chute 22 by the stopping tabs 60 and a buckle (not shown) is formed in the paper 12. Continued feeding of the paper 12 by the rollers 16 and 18 results in the buckle being fed into the nip of the folding rollers 18 and 20 and the formation of a crease in the buckle. The once-folded collation of paper 12 now is fed crease first to the nip of the rollers 20 and 24 which feed the paper 12 into the second buckle chute 26, which is set up so that the plungers 86 can be deflected downward to allow the once-folded paper 12 to totally enter the buckle chute 26 and clear the rollers 20 and 24. The plungers 86 then force the paper 12 upward and out of the buckle chute 26, crease trailing, into the nip of the rollers 24 and 28. The folded paper collation 12 then exits the rollers 24 and 28 for further processing and ultimately insertion into an envelope (not shown).

From the foregoing description, it can be seen that the use of the positively driven, first feed roller 14 enables collations up to about 10 to 12 sheets of paper to enter the first buckle chute 22 without a shingling condition occurring. The soft rubber of the driven roller 14 positively grips the collation 12 together with the second feed roller 16 so that none of the sheets in the collation 12 can slip and become shingled; the uppermost sheet in the collation 12 obviously is a critical sheet in the collation 12.

It should be understood by those skilled in the art that various modifications may be made in the present invention without departing from the spirit and scope thereof, as described in the specification and defined in the appended claims.

What is claimed is:

1. A buckle chute folding system for imparting a fold to a collation of paper sheets, comprising:

a pair of upper and lower feeding rollers defining a first feed nip;

a first folding roller associated with said lower feeding roller downstream of said upper feeding roller, said first folding roller and said lower feeding roller defining a second feed nip and wherein said first folding roller is contiguous with said upper feeding roller;

a substantially vertically oriented buckle chute situated downstream of said second feed nip;

a second folding roller associated with said first folding roller downstream of said buckle chute, said first and second folding rollers defining a third feed nip; and means for positively driving said upper feeding roller, whereby said collation of sheets is fed through said first and second nips without any shingling effects.

2. The folding system of claim 1, additionally comprising a shaft for engaging said upper feeding roller, and a pulley mounted on said shaft, and wherein said positively driving means includes a belt mounted on said pulley.

3. The folding system of claim 1, additionally comprising an entrance bracket upstream of said upper feeding roller and above said lower feeding roller for guiding said collation into said first feed nip.

4. The folding system of claim 3, wherein said entrance bracket includes an underside having a slippery coating to prevent the uppermost papers in said collation from being retarded by said entrance bracket.

5. The folding system of claim 3, wherein the downstream end of said entrance bracket is curved downward toward said first nip.

6. The folding system of claim 1, wherein said upper feeding roller and said first folding roller are segmented and the segments of said upper feeding roller fit between the segments of said first folding roller.

7. The folding system of claim 6, wherein said upper feeding roller is formed from a foam rubber.

* * * * *